US005857919A

United States Patent [19]

Hoyt et al.

[11] Patent Number: 5,857,919

[45] Date of Patent: Jan. 12, 1999

[54] PUTTING PRACTICE DEVICE

[75] Inventors: David Hoyt; Gary T. Aldcroft, both of Gardena, Calif.

[73] Assignee: Principle Plastics, Gardena, Calif.

[21] Appl. No.: 876,185

[22] Filed: Jun. 13, 1997

[51] Int. Cl.[6] ..... A63B 69/36

[52] U.S. Cl. ..... 473/184; 473/179

[58] Field of Search ..... 473/180, 179, 473/174, 175, 178, 181–184

[56] References Cited

U.S. PATENT DOCUMENTS 1,682,601 8/1928 Cunningham ..... 473/179
4,906,006 3/1990 Sigunick ..... 473/179

*Primary Examiner*—Mark S. Graham
*Attorney, Agent, or Firm*—James E. Brunton

[57] ABSTRACT

A putting practice device in which the diameter of the ball-receiving cup of the device can be made smaller or larger to sharpen the putting skills of the golfer. Additionally, the ball-receiving copy of the device is designed so that golf balls entering the cup during the practice session will automatically roll outwardly therefrom by force of gravity.

19 Claims, 2 Drawing Sheets

PUTTING PRACTICE DEVICE

BACKGROUND OF THE INVENTION

FIELD OF THE INVENTION

The present invention relates generally to devices for practicing golf putting techniques. More particularly, the invention concerns a novel putting practice device in which the diameter of the ball-receiving cup of the device can be made smaller or larger to sharpen the putting skills of the golfer.

DISCUSSION OF THE INVENTION

Numerous types of putting practice devices have been suggested in the past. Most of the prior art devices are adapted for indoor use and are typically designed to be placed on a carpeted floor of a home or office. A common drawback of the prior art practice devices is that the golf ball is most always captured within the cup of the device and must be manually lifted therefrom after each successful practice put. In using this type of prior art device, the golfer, after knocking the ball into the cup, must walk to the practice device, remove the golf ball from the cup and then return to the practice putting location. This is time consuming and mitigates against the development of a smooth repetitive putting stroke. To alleviate this problem, some prior art practice devices embody a mechanical or electromechanical ejection mechanism to eject the golf ball from the cup in a direction toward the user. However, such devices tend to be quite complex and often quite costly.

The apparatus of the present invention, not only overcomes the aforementioned drawbacks of the prior art devices, but also provides an additional feature, namely the ability to selectively make the cup size smaller than regulation so as to improve putting accuracy. Further, by providing a slight crown in the base wall of the ball-receiving cup, and by also forming a pair of diametrically opposed, ball-receiving channels in the side wall of the cup, the ball, after entering the cup, will automatically roll out of the cup by force of gravity. This enables the golfer to continue putting a number of balls without interruption thereby enabling the development of a smooth repeatable putting strike.

During the practice session, if the user of the device wishes to reduce the diameter of the golf-ball receiving cup to sharpen putting accuracy, a novel pivotally mounted, size reducing member can be swung into position within the standard size cup of the device. Since the reducer member is also provided with diametrically opposed golf-ball receiving channels, the ball will continue to automatically roll out of the reduced diameter cup as was the case with the standard cup size configuration.

SUMMARY OF THE INVENTION

It is an object of the present invention to provide a novel putting practice device for practicing golf putting techniques in which the diameter of the ball-receiving cup of the device can be made smaller or larger to sharpen the putting skills of the user.

Another object of the invention is to provide a device of the aforementioned character in which the base of the putting cup is provided with a slight crown and in which the wall of the ball-receiving cup is provided with diametrically opposed ball-receiving channels so that the golf ball after entering the cup will automatically roll out of the cup by force of gravity thereby making way for the next ball to enter the cup.

Another object of the invention is to provide a putting practice device as described in the preceding paragraphs which is compact, light-weight and easily transportable for use in the home, the office, or in hotel rooms during travel.

Another object of the invention is to provide a putting practice device which is of simple design, has a minimum number of moving parts and one that can be manufactured in quantity at relatively low cost.

As will be better appreciated from the description which follows, these and other objects of the invention will be fulfilled by the novel device illustrated in the drawings and described hereinafter.

DISCUSSION OF THE INVENTION

Figure 1:
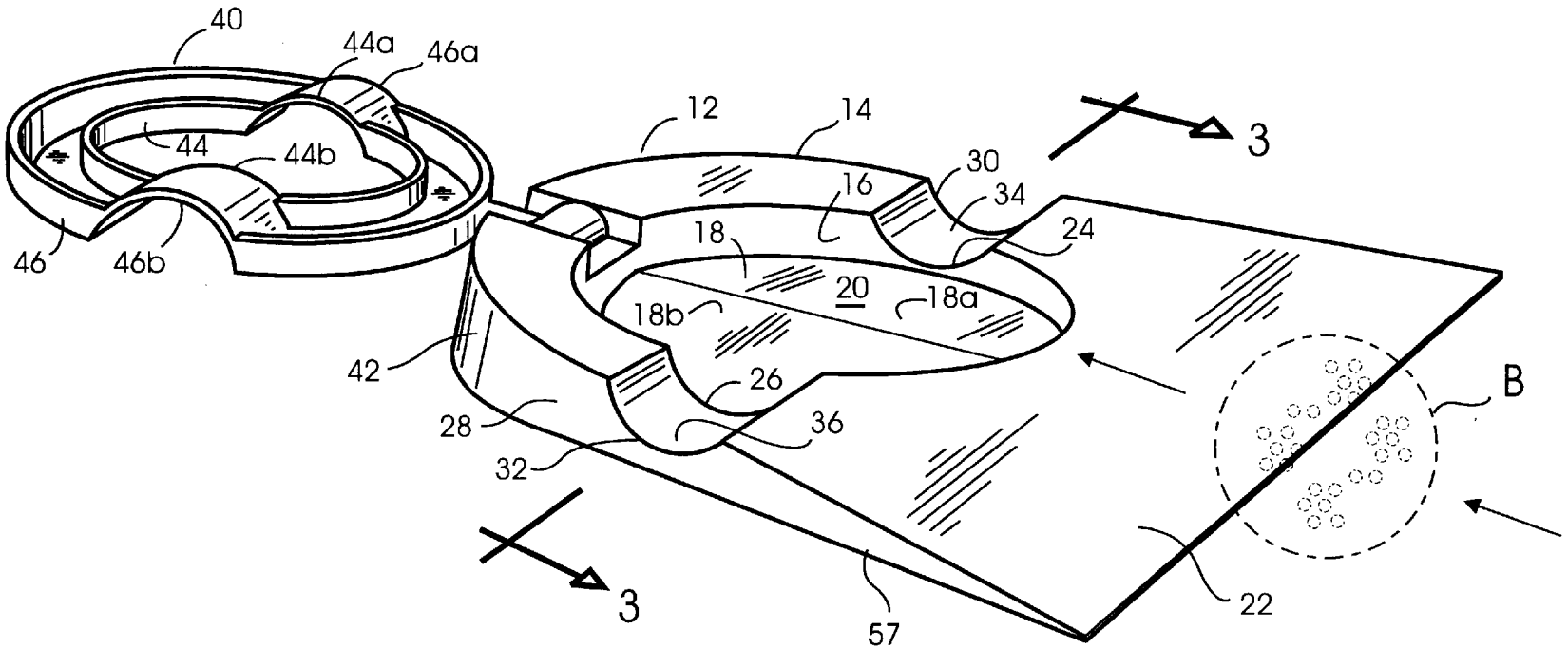
FIG. 1 is a generally perspective view of one form of the apparatus of the invention showing the cup-size adapter in a retracted position.
Figure 2:
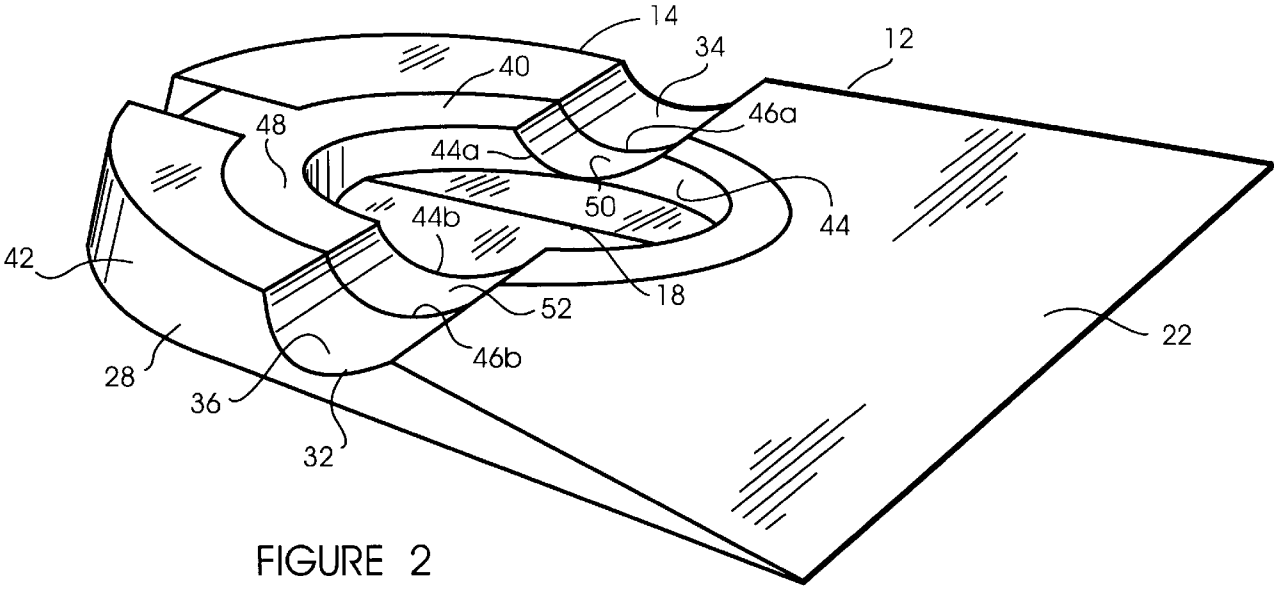
FIG. 2 is a generally perspective view of the device showing the cup-size adapter in an operating position.

Referring to the drawings and particularly to FIGS. 1 and 2, one form of the putting practice device of the present invention is there illustrated and generally identified by the numeral 12. The putting device of the invention here comprises a base 14 having a side wall 16 and a base wall 18 which cooperate to define a generally cup-shaped cavity 20 (FIG. 1). Cavity 20 has a top opening of a first diameter and a forward, upwardly sloping portion 22 which receives the golf ball "B" and permits it to roll upwardly in a direction toward cavity 20.

As best seen in FIG. 1, side wall 16 is provided with a pair of oppositely disposed, generally arcuately shaped ball-receiving openings 24 and 26 respectively. The outer wall 28 of base 14 partially circumscribes cavity 20 and is also provided with first and second generally, arcuately shaped openings 30 and 32 respectively. A generally concave-shaped floor 34 connects openings 24 and 30 while a similarly configured generally concave-shaped floor 36 connects openings 26 and 32.

Figure 3:
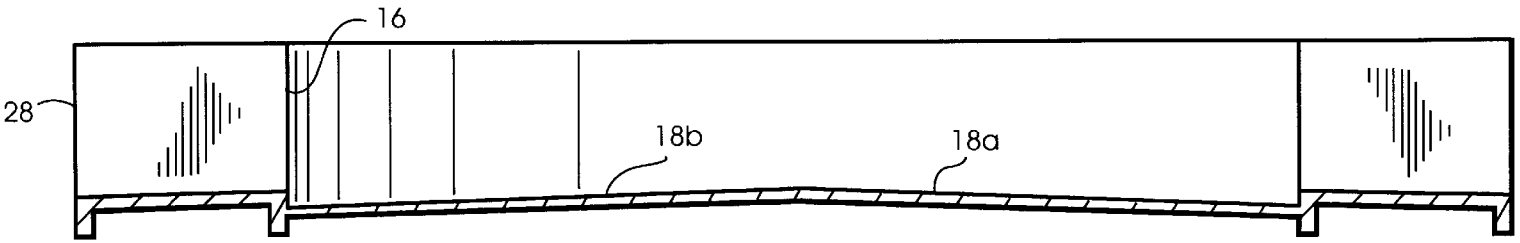
FIG. 3 is an enlarged, cross-sectional view taken along lines 3—3 of FIG. 1.

Referring particularly to FIGS. 1 and 3, it can be seen that base wall 18 is provided with first and second sloping wall portions 18*a* and 18*b* respectively. As shown in FIG. 1, sloping base wall 18*a* slopes toward concave wall 34 while outwardly sloping base wall 18*b* slopes toward concave wall 36. With this construction it is apparent that a golf ball "B" rolling into cavity 20 will roll by force of gravity either toward concave wall 34 or toward concave wall 36. Since openings 24 and 26 are slightly larger than the diameter of the golf ball "B", the golf ball will pass through these openings and roll outwardly by force of gravity onto the surface "S" upon which the putting device 12 rests. This putting surface "S" is preferably a relatively smooth carpeted surface of the character typically found in the home or office.

Also forming an important aspect of the practice putting device of the present invention is a generally ring shaped reducer member 40 which is pivotably connected to a curved rear portion 42 and base 14. Reducer member 40 is connected to base 14 for movement between a first retracted position shown in FIG. 1 to a second reducer position shown in FIG. 2 wherein the reducer member is disposed within the cup shaped cavity 20 of the base. Reducer member 40 includes a first, generally circular shaped wall 44 defining an opening of a second diameter smaller than the first diameter or cavity 20. Accordingly, when the reducer member is in the second reducer position shown in FIG. 2, the target area for the golf ball "B" is reduced in size making putting of the ball "B" into the reduced diameter cavity slightly more difficult. However, if the user perfects a technique for consistently rolling the ball into the reduced diameter cavity, the probability of consistently putting the golf ball into a standard size cavity such as found on the golf course is greatly improved.

As can be seen by referring to FIGS. 1 and 2, reducer member includes a second wall 46 which circumscribes wall 44 and is connected thereto by a top surface 48 (FIG. 2) which spans walls 44 and 46. Wall 44 is provided with a pair of generally arcuately shaped openings 44*a* and 44*b* respectively. Similarly, wall 46 is provided with a pair oppositely disposed arcuately shaped openings 46*a* and 46*b* respectively. Spanning openings 44*a* and 46*a* is a generally concave wall, while spanning openings 44*b* and 46*b* is a generally concave shaped wall 52 (FIG. 2). As indicated in FIG. 2 when reducer member 40 is in the reducer position shown in FIG. 2, the openings provided in the side walls of the reducer member index with openings 24 and 26 provided in side all 16 of base 14 so as to permit the golf ball to roll by force of gravity from cavity 20 outwardly of the device along concave portions 50 and 34 and 52 and 36.

In using the practice device of the invention, initial practice can be commenced with the apparatus in the configuration shown in FIG. 1 with the lower surface 57 of base 14 resting on the surface "S", such as a carpeted surface. In this configuration the reducer member is retracted so that initial practice can begin with the cavity having a first diameter generally corresponding to the diameter of a standard putting cup. As the golf ball "B" rolls into the cavity 20 it will be urged by force of gravity to roll either to the right or to the left and through openings provided in the cavity walls. With this unique construction, the user need not approach the cup after each putt since the ball will automatically roll out of the cavity so as not to obstruct the next ball putted into the cavity by the user.

After an initial warm up period with the apparatus in the configuration shown in FIG. 1, the ring shaped reducer member 40 can be moved into the reducer position shown in FIG. 2. This effectively reduces the size of the putting cup and requires greater accuracy on the part of the user to roll the golf ball "B" up ramp 22 and into the reduced diameter cavity of the putting device. Due to the unique configuration of reducer ring 40, the golf balls rolling into the cavity 20 will once again roll by force of gravity through one or the other of the side openings provided in the reducer ring and in the base member thereby clearing the putting cavity for receipt of the next practice ball putted by the user.

The putting device of the present application can be constructed from a variety of materials, however, a moldable plastic material is preferred so as to reduce manufacturing costs. If the cost of the device is not critical, the base as well as the reducer member 40 can be constructed of metal such as aluminum or other suitable materials of choice.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A putting practice device comprising:

(a) a base having a side wall and a base wall which cooperate to define a generally cup-shaped cavity having an opening therein of a first diameter; and (b) a generally ring-shaped, reducer member pivotally connected to said base for movement between a first retracted position and a second reducer position wherein said reducer member is disposed within said cup-shaped cavity of said base, said reducer member including a first wall defining an opening of a second diameter smaller than said first diameter.

2. A device as defined in claim 1 in which said side wall of said base wall has at least one generally arcuately shaped, ball-receiving opening formed therein.

3. A device as defined in claim 2 in which said base wall includes a first portion sloping outwardly toward said generally arcuately shaped, ball-receiving opening formed in said side wall.

4. A device as defined in claim 3 in which said side wall of said base has first and second generally arcuately shaped, ball receiving-openings formed therein and in which said base wall of said base has a second portion sloping outwardly toward said second generally arcuately shaped, ball-receiving opening.

5. A device as defined in claim 4 in which said first wall of said reducer member has first and second generally arcuately shaped, ball-receiving openings indexable with said first and second generally arcuately shaped, ball-receiving openings provided in said side wall of said base when said reducer member is in said second-reducer portion.

6. A device as defined in claim 5 in which said reducer member has a second wall spaced apart from and circumscribing said first wall, said second wall having first and second generally arcuately shaped, ball-receiving openings provided therein.

7. A device as defined in claim 6 further including first and second concave walls interconnecting said first and second generally arcuately shaped openings provided in said first and second walls of said reducer member.

8. A putting practice device comprising:

(a) a base having a side wall and a base wall which cooperate to define a generally cup-shaped cavity having an opening therein of a first diameter, said side wall having first and second generally arcuately shaped, ball-receiving openings provided therein and said base wall having first and second sloping portions sloping toward said first and second generally arcuately shaped, ball-receiving openings respectively; and (b) a generally ring-shaped reducer member pivotally connected to said base for movement between a first retracted position and a second reducer position wherein said reducer member is disposed within said cup-shaped cavity of said base, said reducer member including a first wall defining an opening of a second diameter smaller than said first diameter.

9. A device as defined in claim 8 in which said reducer member includes a second wall spaced apart from and circumscribing said first wall, said first and second walls of said reducer member each having first and second generally arcuately shaped openings indexable with said first and second generally arcuately shaped, ball-receiving openings provided in said side wall of said base when said cup-size reducer member is in said second-reducer portion.

10. A device as defined in claim 9 further including first and second concave walls interconnecting said first and second generally arcuately shaped openings provided in said first and second walls of said reducer member.

11. A device as defined in claim 10 in which said base further includes a forward ramp portion and an oppositely disposed connector portion to which said reducer member is pivotally connected.

12. A putting practice device comprising:

(a) a base having a generally cup-shaped cavity having an opening therein of a first diameter; and (b) a generally ring-shaped reducer member pivotally connected to said base for movement between a first retracted position and a second reducer position wherein said reducer member is disposed within said cup-shaped cavity of said base, said reducer member having an opening of a second diameter smaller than said first diameter.

13. A device as defined in claim 12 in which said base has a side wall and a base wall defining said cup-shaped cavity, said side wall having at least one generally arcuately shaped, ball-receiving opening formed therein.

14. A device as defined in claim 13 in which said base wall includes a first portion sloping outwardly toward said generally arcuately shaped, ball-receiving opening in said side wall.

15. A device as defined in claim 14 in which said side wall has first and second generally arcuately shaped, ball receiving-openings formed therein and in which said base wall has a second portion sloping outwardly toward said second generally arcuately shaped, ball-receiving opening.

16. A device as defined in claim 15 in which said reducer member comprises a first wall defining said opening of a second diameter, said first wall having first and second generally arcuately shaped, ball-receiving openings indexable with said first and second generally arcuately shaped, ball-receiving openings provided in said side wall of said base when said cup-size reducer member is in said second-reducer portion.

17. A device as defined in claim 16 in which said reducer member has a second wall spaced apart from and circumscribing said first wall, said second wall having first and second generally arcuately shaped, ball-receiving openings provided therein.

18. A device as defined in claim 17 further including first and second concave walls interconnecting said first and second generally arcuately shaped openings provided in said first and second walls of said reducer member.

19. A device as defined in claim 18 in which said base further includes a forward ramp portion and an oppositely disposed connector portion to which said reducer member is pivotally connected.

* * * * *